US012276008B2

(12) United States Patent
Wei et al.

(10) Patent No.: US 12,276,008 B2
(45) Date of Patent: Apr. 15, 2025

(54) TUNGSTEN-BASE ALLOY MATERIAL AND PREPARATION METHOD THEREFOR

(71) Applicant: HENAN UNIVERSITY OF SCIENCE AND TECHNOLOGY, Henan (CN)

(72) Inventors: Shizhong Wei, Henan (CN); Liujie Xu, Henan (CN); Fangnao Xiao, Henan (CN); Kunming Pan, Henan (CN); Yucheng Zhou, Henan (CN); Xiuqing Li, Henan (CN); Jiwen Li, Henan (CN); Xiran Wang, Henan (CN); Xiaodong Wang, Henan (CN); Cheng Zhang, Henan (CN); Chong Chen, Henan (CN); Feng Mao, Henan (CN); Mei Xiong, Henan (CN); Guoshang Zhang, Henan (CN); Dongliang Jin, Henan (CN)

(73) Assignee: HENAN UNIVERSITY OF SCIENCE AND TECHNOLOGY, Henan (CH)

( * ) Notice: Subject to any disclaimer, the term of this patent is extended or adjusted under 35 U.S.C. 154(b) by 465 days.

(21) Appl. No.: 17/633,962

(22) PCT Filed: Aug. 12, 2020

(86) PCT No.: PCT/CN2020/108558
§ 371 (c)(1),
(2) Date: Feb. 9, 2022

(87) PCT Pub. No.: WO2021/027824
PCT Pub. Date: Feb. 18, 2021

(65) Prior Publication Data

US 2022/0325380 A1 Oct. 13, 2022

(30) Foreign Application Priority Data

Aug. 12, 2019 (CN) ..... 201910740731.2

(51) Int. Cl.
*C22C 1/04* (2023.01)
*B21C 23/00* (2006.01)
(Continued)

(52) U.S. Cl.
CPC ..... *C22C 1/045* (2013.01); *B21C 23/002* (2013.01); *B21C 23/007* (2013.01); *B22F 1/142* (2022.01);
(Continued)

(58) Field of Classification Search
CPC ..... B22F 2301/20; B22F 2302/25
See application file for complete search history.

(56) References Cited

U.S. PATENT DOCUMENTS 3,696,486 A 10/1972 Benjamin
5,740,516 A * 4/1998 Jiranek, II ..... F41A 3/12 42/16
2016/0074942 A1* 3/2016 Fang ..... B22F 1/09 75/245

FOREIGN PATENT DOCUMENTS

CN 101386947 A * 3/2009
CN 101896300 11/2010
(Continued)

OTHER PUBLICATIONS

Theisen, Werner, and Markus Karlsohn. "Hot direct extrusion—A novel method to produce abrasion-resistant metal-matrix composites." Wear 263.7-12 (2007): 896-904 (Year: 2007).*
(Continued)

*Primary Examiner* — Brian D Walck
*Assistant Examiner* — Sean P. O'Keefe
(74) *Attorney, Agent, or Firm* — JCIP GLOBAL INC.

(57) ABSTRACT

A tungsten-base alloy material and a preparation method therefor. The preparation method comprises: 1) evenly grinding composite powder containing tungsten and zirco-
(Continued)

nium oxide, and then performing annealing treatment at 700-1000° C. to obtain powder A; and 2) grinding and then compression moulding the powder A, and then performing liquid-phase sintering to obtain a tungsten-base alloy blank so as to obtain the tungsten-base alloy material.

17 Claims, 1 Drawing Sheet

(51) Int. Cl.

| | |
|---|---|
| ***B22F 1/142*** | (2022.01) |
| ***B22F 3/10*** | (2006.01) |
| ***B22F 3/16*** | (2006.01) |
| ***B22F 9/04*** | (2006.01) |
| ***B22F 9/24*** | (2006.01) |
| ***C22C 27/04*** | (2006.01) |
| ***C22C 28/00*** | (2006.01) |
| ***C22F 1/18*** | (2006.01) |

(52) U.S. Cl.
CPC ..... *B22F 3/1035* (2013.01); *B22F 3/16* (2013.01); *B22F 9/04* (2013.01); *B22F 9/24* (2013.01); *C22C 27/04* (2013.01); *C22C 28/00* (2013.01); *C22F 1/18* (2013.01); *B22F 2009/043* (2013.01); *B22F 2301/20* (2013.01); *B22F 2302/25* (2013.01)

(56) References Cited

FOREIGN PATENT DOCUMENTS

| | | | | |
|---|---|---|---|---|
| CN | 104072124 | | 10/2014 | |
| CN | 104313377 | A * | 1/2015 | |
| CN | 105385986 | | 3/2016 | |
| CN | 105441765 | | 3/2016 | |
| CN | 105441765 | A * | 3/2016 | ..... B22F 9/26 |
| CN | 105441766 | | 3/2016 | |
| CN | 105958039 | | 9/2016 | |
| CN | 106048360 | | 10/2016 | |
| CN | 106801178 | | 6/2017 | |
| CN | 107604186 | | 1/2018 | |
| CN | 108277411 | | 7/2018 | |
| CN | 108504916 | | 9/2018 | |
| CN | 110358941 | | 10/2019 | |
| JP | S58144401 | | 8/1983 | |
| JP | 2009208125 | | 9/2009 | |
| KR | 2009050732 | A * | 5/2009 | |

OTHER PUBLICATIONS

CN105441766A English language translation (Year: 2016).*
Yu, Yang, et al. "Microstructure evolution and recrystallization after annealing of tungsten heavy alloy subjected to severe plastic deformation." Journal of Alloys and Compounds 685 (2016): 971-977 (Year: 2016).*
CN107604186A English language translation (Year: 2017).*
Lee, Kyong H., et al. "Effect of mechanical alloying process on microstructure and mechanical properties of ODS tungsten heavy alloys." Journal of alloys and compounds 434 (2007): 433-436 (Year: 2007).*
"International Search Report (Form PCT/ISA/210)" of PCT/CN2020/108558, with English translation thereof, mailed on Nov. 17, 2020, pp. 1-6.

* cited by examiner

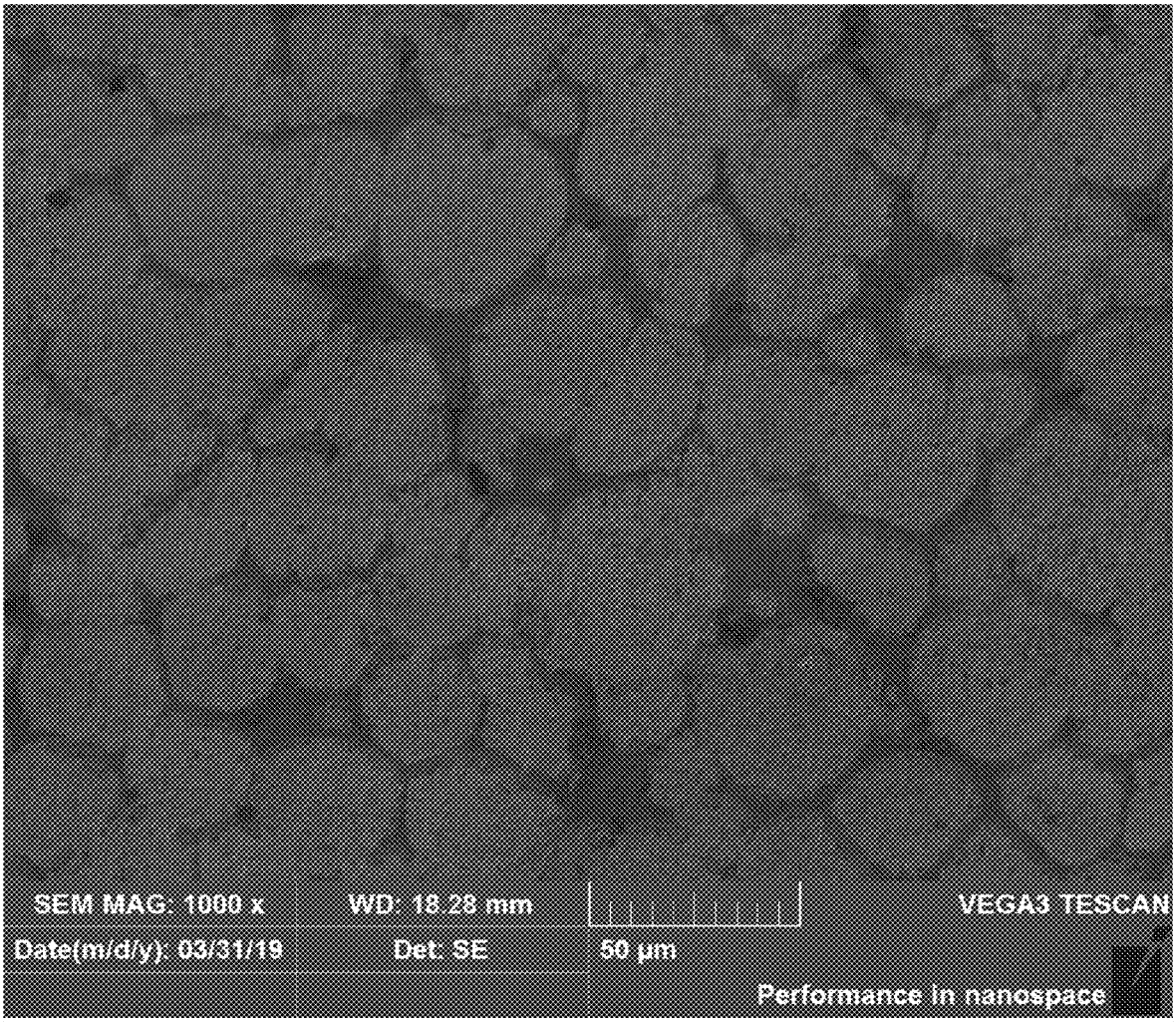
SEM MAG: 1000 x
WD: 18.28 mm
VEGA3 TESCAN
Date(m/d/y): 03/31/19
Det: SE
50 μm
Performance in nanospace

TUNGSTEN-BASE ALLOY MATERIAL AND PREPARATION METHOD THEREFOR

CROSS-REFERENCE TO RELATED APPLICATION

This is a 371 application of the International PCT application serial no. PCT/CN2020/108558, filed on Aug. 12, 2020, which claims the priority benefits of China Application No. 201910740731.2, filed on Aug. 12, 2019. The entirety of each of the above-mentioned patent applications is hereby incorporated by reference herein and made a part of this specification.

FIELD OF THE DISCLOSURE

The disclosure relates to a tungsten-base alloy material and a preparation method therefor, and belongs to the technical field of tungsten-base alloy materials.

DESCRIPTION OF RELATED ART

High-density tungsten-base alloy is a kind of alloy with tungsten as the matrix and added with elements such as Ni, Fe, Co, Cu, Mo, Cr, etc. The density of tungsten-base alloy is typically 17.5 to 19.0 g/cm$^3$. High-density tungsten-base alloy has high density, high strength and good wear resistance and radiation absorption. These advantages make tungsten-base alloy an ideal material for many industrial applications, especially in the field of national defense industry. High-density tungsten-base alloy is widely used in the production of various rod-type kinetic energy armor-piercing projectile cores and missile damage unit components. However, high-density tungsten-base alloy is a typical hard-to-deform material. The strength performance of conventional powder metallurgy liquid-phase sintered tungsten-base alloy is relatively low, which severely limits its armor penetration performance when used as a bullet core. Oxide dispersion-strengthened W—Ni—Fe alloy is one of the most promising tungsten-base alloy materials. Even if the W—Ni—Fe alloy is prepared by conventional liquid phase sintering, compared to conventional tungsten-base alloy, W—Ni—Fe alloy still has an advantage in terms of high-temperature strength because the oxide particles in the matrix serve as pinning points to hinder the migration of dislocations and sub-grain boundaries. For example, Chinese invention patent with publication number CN105441765B discloses a high-density tungsten alloy for bullets. In terms of mass percentage, the ingredients of alloy are as follows: tungsten 90.0 to 97.0%, zirconium oxide 0.1 to 2.0%, and the nickel-iron binder phase 2.0 to 9.9%, the mass ratio of nickel to iron is 3~4:2~1, and inevitable impurities. The preparation steps of the high-density tungsten alloy for bullets are as follows: ammonium metatungstate and zirconium nitrate are dissolved in water respectively and mixed, the mixed solution is dried to obtain powder, and the powder is sintered and reduced to obtain composite tungsten powder; nickel powder and iron powder are taken, mixed and ball milled to obtain a nickel-iron solid solution; the composite tungsten powder and nickel-iron solid solution are mixed to obtain mixed powder, after compression moulding and sintering the mixed powder, a high-density tungsten alloy for bullets is obtained. The high-density tungsten alloy used for bullets is added with high-temperature stable phase zirconium oxide in the tungsten alloy during the preparation process. The zirconium oxide dispersed phase is small and uniformly distributed in the tungsten matrix, which solves the problem of poor mechanical properties caused by uneven phase distribution. The tensile strength of tungsten alloy can reach 1250 MPa or more. However, because the processing time is as long as 20 to 35 hours in the process of mixing composite tungsten powder and nickel-iron alloy by ball milling, the metal powder in the mixed powder in the later period of ball milling becomes work hardening, which makes it difficult to effectively grind the zirconium oxide particles and also hinders further improvement of distribution uniformity and further reduction of grain size of zirconium oxide. Accordingly, the tensile strength performance of the tungsten-base alloy is limited.

SUMMARY OF THE DISCLOSURE

The purpose of the disclosure is to provide a method for preparing a tungsten-base alloy material, which can improve the tensile strength of a high-density tungsten-base alloy.

The disclosure further provides a tungsten-base alloy material prepared by the above preparation method, and the tungsten-base alloy material has a high tensile strength.

In order to achieve the above purpose, the technical solution adopted in the preparation method for the tungsten-base alloy material of the disclosure is as follows.

A tungsten-base alloy material preparation method includes the following steps.

Composite powder is evenly ground then subjected to annealing treatment at the temperature of 700 to 1000° C. to obtain powder A. The composite powder is powder I, powder II or powder III. The powder I contains tungsten, zirconium oxide, nickel and iron; the powder II contains tungsten, zirconium oxide, and nickel-iron solid solution; the powder III contains tungsten, zirconium oxide, and zirconium hydride-containing nickel-iron solid solution. The mass ratio of nickel element and iron element in the composite powder is 7:2 to 5.

2) The powder A is ground and compression-moulded into a shape, and then liquid-phase sintered to obtain a tungsten-base alloy blank.

In the preparation method for the tungsten-base alloy material of the disclosure, the powder is annealed after the first grinding to make the metal particles soft, and then the powder is ground again, which overcomes the problem that when single grinding is used in the conventional technology, zirconium oxide particles cannot be effectively ground in the later period of material mixing when work hardening for metal particles is performed on zirconium oxide particles. Grinding-annealing-grinding method is adopted for mixing, so that the grain size of the zirconium oxide particles is decreased and the degree of uniform distribution of the zirconium oxide particles in the powder is improved. In this way, the tensile strength and hardness of the tungsten-base alloy which is obtained after sintering is improved. The tungsten-base alloy material prepared by the preparation method of the disclosure has a high strength while maintaining high plasticity, with a density of 98% or more, a microhardness of 445 Hv or more, a tensile strength of 1450 Mpa or more, and an elongation rate of 15% or more.

In order to further optimize the performance of powder A, the grain size of zirconium oxide is reduced, and the degree of dispersion uniformity of the components is improved. In step 2), the grinding is ball milling; the rotation speed of the ball milling is 200 to 400 rpm, the time is 6 to 10 hours, and the ball-to-material ratio is 5 to 8:1. It should be noted that the ball-to-material ratio of the disclosure is mass ratio. If the ball milling time is too short, it is unfavorable to refine the composite powder particles and reduce the densification of the alloy. If the ball milling time is too long, the morphology of the tungsten powder particles is flake, and the surface area of the tungsten powder particles with flake morphology is large. As a result, agglomeration is likely to occur and therefore the powder voids will remain in the alloy blank, which makes it unfavorable to improve the strength of the compressed compact.

In order to achieve a better annealing effect while reducing energy consumption, preferably, the annealing treatment is performed at 700 to 1000° C., and the temperature is kept for 1 to 3 hours.

In order to reduce the weakening effect of harmful elements such as N, C, and O on the grain boundary strength of the alloy at the grain boundary, while improving the bonding strength of the grain boundary, preferably, the powder I consists of tungsten, zirconium oxide, nickel, iron, and zirconium hydride. The ratio of the mass of tungsten, the mass of zirconium oxide, the total mass of nickel and iron and the mass of zirconium hydride in the powder I is 93:0.066 to 0.267:6.5 to 6.9:0.033 to 0.133. The powder II consists of tungsten, zirconium oxide, nickel-iron solid solution and zirconium hydride. The mass ratio of tungsten, zirconium oxide, nickel-iron solid solution and zirconium hydride in powder II is 93:0.066 to 0.267:6.5 to 6.9:0.033 to 0.133. The mass ratio of tungsten, zirconium oxide, and zirconium hydride-containing nickel-iron solid solution in the powder III is 93:0.066 to 0.267:6.533 to 7.033. The mass ratio of zirconium oxide to zirconium hydride contained in zirconium hydride-containing nickel-iron solid solution is 0.066 to 0.267:0.033 to 0.133. The zirconium hydride in the composite powder is easily decomposed at high temperature, producing zirconium metal and N, C, O and other harmful elements distributed at the grain boundary to form high-temperature refractory carbon (oxygen or nitrogen) compounds with fine particles, thereby expediting the reduction of the concentration of harmful elements at the alloy grain boundary. Meanwhile, the small stable refractory carbon (oxygen or nitrogen) compounds hinder the growth of crystal grains, which is favorable to the improvement of the high-temperature strength, recrystallization temperature and creep resistance performance of tungsten-base alloy, and the increase of recrystallization temperature helps to maintain the effect of deformation strengthening of tungsten-base alloy.

Preferably, the preparation method for the zirconium hydride-containing nickel-iron solid solution in powder III includes the following steps: nickel powder, iron powder and zirconium hydride powder are mixed and then ball milled to obtain the powder III. In the preparation method for zirconium hydride-containing nickel-iron solid solution, the rotation speed of the ball milling is 200 to 350 rpm, the time is 12 to 16 hours, and the ball-to-material ratio is 5 to 8:1.

Preferably, powder I is obtained by mixing iron powder, nickel powder and mixed powder as main raw materials; powder II is obtained by mixing nickel-iron solid solution powder and mixed powder as main raw materials; and powder III is obtained by mixing a zirconium hydride-containing nickel-iron solid solution with a mixed powder. The mixed powder used to prepare powder I, powder II, and powder III is prepared by a method including the following steps.

i) Tungsten trioxide suspension and hydrogen zirconium oxide suspension are prepared.

a) Ammonium metatungstate is formulated into a precursor solution A with a pH≤1, and then the precursor solution A is subjected to a hydrothermal reaction to obtain a tungsten trioxide suspension.

b) Zirconium nitrate is formulated into a precursor solution B with a pH of 11 to 13, and then the precursor solution B is subjected to a hydrothermal reaction to obtain a hydrogen zirconium oxide suspension.

ii) Then the tungsten trioxide suspension and the hydrogen zirconium oxide suspension are mixed uniformly, the solvent is removed to make a powder, and then the powder is sequentially sintered and reduced to obtain the mixed powder as required.

The way of adding zirconium oxide has an important impact on the mechanical properties of tungsten-base alloy. The mixed powder used in the above-mentioned powder I, powder II, and powder III is zirconium oxide doped with composite tungsten powder. The zirconium oxide doped with composite tungsten powder is obtained through liquid-liquid doping by respectively subjecting ammonium metatungstate solution and the zirconium nitrate solution to hydrothermal reaction. The reaction products are fully mixed, and then sintered and reduced. In this way, the liquid-liquid doping and co-reduction process ensure that the zirconium oxide particles in the mixed powder has fine grain size and uniformly distributed in the tungsten powder. In the meantime, the size of the mixed powder particles can be distributed normally, which is favorable to the improvement of the strength of the compressed compact and thus enhancing the alloy density.

In order to further improve the performance of the tungsten-base alloy material, preferably, the preparation method for the tungsten-base alloy material further includes subjecting the tungsten-base alloy blank to hydrostatic extrusion deformation treatment and aging treatment. The temperature of the aging treatment is 800 to 1100° C., and the time is 7 to 10 hours.

During the preparation process of tungsten-base alloy material, the trace hydrogen entering the material causes embrittlement or even cracking of the material under the action of internal residual stress or external stress. In order to avoid this situation, preferably, before the hydrostatic extrusion deformation treatment is performed, the prepared tungsten-base alloy blank is subjected to dehydrogenation treatment. The dehydrogenation treatment is carried out in an inert atmosphere at the temperature of 1150 to 1300° C., and the temperature is kept for 4 to 6 hours, and then the tungsten-base alloy blank is cooled in the furnace. Dehydrogenation treatment can prevent the prepared tungsten-base alloy material from exhibiting high hydrogen embrittlement during use.

Preferably, the temperature of the liquid phase sintering is 1450 to 1550° C.; the time is 90 to 150 minutes. If the sintering temperature is too low or the sintering time is too short, the doped phase will not be wetted or poorly wetted with respect to the tungsten phase, resulting in a weaker interface between the two phases, which is likely to cause cracks. When the sintering temperature is too high or the sintering time is too long, the tungsten grains will aggregate and grow, resulting in uneven tungsten particles in the alloy and uneven distribution of the binder phase, which tends to reduce the extensibility of the alloy.

The technical solution adopted by the tungsten-base alloy material of the disclosure is as follows.

A tungsten-base alloy material is prepared by the above-mentioned preparation method for tungsten-base alloy material.

The tungsten-base alloy material of the disclosure is prepared by the above-mentioned preparation method for tungsten-base alloy material. The tungsten-base alloy material has high density, microhardness, tensile strength and elongation rate, with a density of 98% or more, a microhardness of 445 Hv or more, a tensile strength of 1450 Mpa or more, and an elongation rate of 15% or more.

BRIEF DESCRIPTION OF THE DRAWINGS

FIG. 1 is a scanning electron micrograph of a tungsten-base alloy material prepared by the preparation method of Embodiment 4 of the disclosure.

DESCRIPTION OF EMBODIMENTS

The method for preparing tungsten-base alloy material provided by the disclosure includes the following steps.

1) Composite powder is evenly ground then subjected to annealing treatment at the temperature of 700 to 1000° C. to obtain powder A. The composite powder is powder I, powder II or powder III. The powder I contains tungsten, zirconium oxide, nickel and iron; the powder II contains tungsten, zirconium oxide, and nickel-iron solid solution; the powder III contains tungsten, zirconium oxide, and zirconium hydride-containing nickel-iron solid solution. The mass ratio of nickel element and iron element in the composite powder is 7:2 to 5.

2) The powder A is ground and compression-moulded into a shape, and then liquid-phase sintered to obtain a tungsten-base alloy blank.

In order to prevent the powder from being oxidized during the annealing process, in the specific embodiment of the method for preparing the tungsten-base alloy material of the disclosure, the annealing treatment is performed in a hydrogen atmosphere or an inert atmosphere containing hydrogen. Also in order to avoid oxidation of the powder during the sintering process, the sintering process may also be carried out in a hydrogen atmosphere or an inert atmosphere containing hydrogen. An inert atmosphere containing hydrogen is, for example, a mixed gas of hydrogen and argon.

In the specific embodiment of the preparation method for the tungsten-base alloy material of the disclosure, the grinding in step 1) and step 2) is ball milling. The material of the grinding ball used in the ball milling is preferably WC. The grain size of the grinding balls used in the ball milling is preferably 3 to 6 mm. The ball-to-material ratio in the ball milling process is 5:1 to 8:1, preferably 6:1. The rotation speed of the ball milling in step 1) and step 2) is preferably 200 to 350 rpm. In order to prevent the metal from being oxidized during the ball milling process, the ball milling in step 1) and step 2) is preferably performed in a protective atmosphere. The protective atmosphere is preferably argon. For example, high-purity argon with a purity of 99.99% or more can be used as the protective atmosphere to prevent the powder from being oxidized during the ball milling process.

In the specific embodiment of the preparation method for the tungsten-base alloy material of the disclosure, the composite powder may be powder I. The powder I contains tungsten, zirconium oxide, iron and nickel. The ratio of the mass of tungsten, the mass of zirconium oxide, and the total mass of nickel and iron in powder I is 93:0.066 to 0.267:6.5 to 6.9. Further, the powder I further includes zirconium hydride; the mass ratio of the zirconium hydride to tungsten is 0.033 to 0.133:93. Furthermore, the mass ratio of zirconium oxide to zirconium hydride in the powder I is 1.8 to 2.2:1.

In the specific embodiment of the preparation method for the tungsten-base alloy material of the disclosure, the composite powder may also be powder II. The powder II contains tungsten, zirconium oxide and nickel-iron solid solution. The mass ratio of tungsten, zirconium oxide and nickel-iron solid solution in the powder II is 93:0.066 to 0.267:6.5 to 6.9. Further, the powder II further includes zirconium hydride. The mass ratio of the zirconium hydride to tungsten is 0.033 to 0.133:93. Moreover, the mass ratio of zirconium oxide to zirconium hydride in the powder II is 1.8 to 2.2:1.

In the specific embodiment of the preparation method for the tungsten-base alloy material of the disclosure, the composite powder may also be powder III. In the powder III, the mass ratio of tungsten, zirconium oxide, and zirconium hydride-containing nickel-iron solid solution is 93:0.066 to 0.267:6.533 to 7.033. The mass ratio of zirconium oxide to zirconium hydride contained in the zirconium hydride-containing nickel-iron solid solution is 0.066 to 0.267:0.033 to 0.133. Furthermore, the mass ratio of zirconium oxide to zirconium hydride in the powder III is 1.8 to 2.2:1.

In the specific embodiment of the method for preparing the tungsten-base alloy material of the disclosure, the method for preparing the zirconium hydride-containing nickel-iron solid solution in the powder III includes the following steps. Nickel powder, iron powder and zirconium hydride powder are mixed and ball milled to obtain the powder III. In the preparation method for the zirconium hydride-containing nickel-iron solid solution, the rotation speed of the ball mill is 200 to 350 rpm, the time is 12 to 16 hours, and the ball-to-material ratio is 5 to 8:1. Specifically, the ball-to-material ratio is preferably 6:1. Under the circumstances, the zirconium hydride-containing nickel-iron solid solution obtained by ball milling is sub-micron size.

In order to prevent the metal from being oxidized during the ball milling process, in the specific embodiment of the method for preparing the tungsten-base alloy material of the disclosure, the ball milling in step 1) and step 2) is preferably performed in a protective atmosphere. The protective atmosphere is preferably argon. For example, high-purity argon with a purity of 99.99% or more can be used as the protective atmosphere.

In the specific embodiment of the preparation method for the tungsten-base alloy material of the present disclosure, the composite powder may be powder I. The powder I is obtained by mixing iron powder, nickel powder and mixed powder as the main raw material. In the case where the powder I further includes zirconium hydride, the powder I is obtained by mixing iron powder, nickel powder, zirconium hydride powder and mixed powder. In the powder I, nickel and iron are in elementary form.

In the specific embodiment of the preparation method for the tungsten-base alloy material of the disclosure, the composite powder may also be powder II. The powder II is obtained by mixing a nickel-iron solid solution powder and a mixed powder as the main raw materials. In the case where powder II further includes zirconium hydride, powder II is obtained by mixing nickel-iron solid solution powder, zirconium hydride powder and mixed powder. In the powder II, nickel and iron are in solid solution form.

In the specific embodiment of the preparation method for the tungsten-base alloy material of the disclosure, the composite powder may also be powder III. The powder III is obtained by mixing a zirconium hydride-containing nickel-iron solid solution and the mixed powder. In the powder III, nickel and iron are in solid solution form.

The mixed powder used to prepare powder I, powder II, and powder III in the specific embodiment of the above preparation method is prepared by a method including the following steps.

i) Tungsten trioxide suspension and hydrogen zirconium oxide suspension are prepared.

a) Ammonium metatungstate is formulated into a precursor solution A with a pH≤1, and then the precursor solution A is subjected to a hydrothermal reaction to obtain a tungsten trioxide suspension.

b) Zirconium nitrate is formulated into a precursor solution B with a pH of 11 to 13, and then the precursor solution B is subjected to a hydrothermal reaction to obtain a hydrogen zirconium oxide suspension.

ii) Then the tungsten trioxide suspension and the hydrogen zirconium oxide suspension are mixed uniformly, the solvent is removed to make a powder, and then the powder is sequentially sintered and reduced to obtain the mixed powder as required.

In the specific embodiment of the preparation method for the tungsten-base alloy material of the disclosure, in step a), the precursor solution A is obtained by dissolving ammonium metatungstate in water and adjusting pH≤1 with nitric acid. In step a), the temperature of the hydrothermal reaction is 120 to 180° C., and the time is 12 to 18 hours. The precursor solution A undergoes hydrothermal reaction to obtain spherical tungsten trioxide particles.

In the specific embodiment of the preparation method for the tungsten-base alloy material of the disclosure, in step b), the precursor solution B is obtained by dissolving zirconium nitrate in water and then adjusting the pH to 11 to 13 with ammonia. In step b), the temperature of the hydrothermal reaction is 120 to 180° C., and the time is 12 to 18 hours. The precursor solution B undergoes a hydrothermal reaction to obtain a nano-scale flocculent hydrogen zirconium oxide suspension.

In the specific embodiment of the preparation method for the tungsten-base alloy material of the disclosure, in step ii), the temperature of the sintering is 600 to 700° C.; the time of the sintering is 3 to 5 hours.

In the specific embodiment of the preparation method for the tungsten-base alloy material of the disclosure, in step ii), the reduction is a two-stage reduction. The temperature of the first-stage reduction is 700 to 770° C., and the time is 1 to 2 hours. The temperature of the second-stage reduction is 900 to 950° C., and the time is 2 to 4 hours. The reduction is performed by using hydrogen.

In the specific embodiment of the preparation method for tungsten-base alloy material of the disclosure, the preparation method for the tungsten-base alloy material further includes subjecting the tungsten-base alloy blank to hydrostatic extrusion deformation treatment and aging treatment. The working pressure of the hydrostatic extrusion deformation treatment is 950 to 1300 MPa, and the extrusion speed is 30 to 50 m/s. The deformation rate of the hydrostatic extrusion deformation treatment is preferably 15 to 50%. Hydrostatic extrusion is an advanced material plastic processing technology. Compared with ordinary material deformation technology, the advantage of hydrostatic extrusion is that the material is always in good lubrication conditions and favorable three-way compressive stress during the deformation process, which allows the material to obtain a larger processing rate at room temperature, thereby obtaining a greater deformation strengthening effect. Such method is particularly suitable for the processing of brittle materials. The typical deformation processing method for tungsten-base alloy with strengthened oxide particles of high specific gravity is die forging, and the deformation is generally no more than 25% at a time. In order to achieve the performance of tungsten-base alloy material with high specific gravity, it is generally necessary to carry out 2 to 3 times of die forging. The process is complicated and the cost is high. However, through the hydrostatic extrusion deformation treatment, one deformation (generally 50% or more can be achieved at a time) only can meet the requirements of tungsten-base alloy material with high specific gravity, and the forming accuracy is high and the production efficiency is fast. In the process of hydrostatic extrusion, the mold can adopt a straight concave model line, and the mold angle is controlled to $2\alpha=60°$. The high-pressure lubricating medium can be selected from 30 #engine oil or castor oil. In the specific implementation process, different sizes of extrusion dies can be used to obtain extruded samples of tungsten-base alloy material with deformations of 15%, 30%, 36%, 45%, and 50%. The temperature of the aging treatment is 800 to 1100° C., and the time is 7 to 10 hours.

In the specific embodiment of the method for preparing the tungsten-base alloy material of the disclosure, before the hydrostatic extrusion treatment is performed, the prepared tungsten-base alloy blank is subjected to dehydrogenation treatment. The dehydrogenation treatment is carried out in an inert atmosphere at the temperature of 1150 to 1300° C., and the temperature is kept for 4 to 6 hours, and then the tungsten-base alloy blank is cooled in the furnace. The inert atmosphere is preferably an argon atmosphere.

In the specific embodiment of the preparation method for the tungsten-base alloy material of the disclosure, the pressure used for the compression moulding is 300 to 400 MPa, and the pressure holding time is 30 to 40 minutes. Under this pressure, a cold compact with a higher density, a more uniform density distribution and a more uniform porosity can be obtained, which facilitates the uniform filling of the pores in the liquid phase in the subsequent liquid phase sintering process, so that it is not easy to cause component segregation. Preferably, the compression moulding is cold isostatic pressing.

In the specific embodiment of the preparation method for the tungsten-base alloy material of the disclosure, the temperature of the liquid phase sintering is 1450 to 1550° C., preferably 1480 to 1540° C. The time of the liquid phase sintering is preferably 90 to 150 minutes, and more preferably 90 to 135 minutes.

The technical solution of the disclosure will be further described below in conjunction with specific embodiments.

The material of the grinding ball used in the ball milling in the following embodiments 1 to 4 is WC, the diameter of the grinding ball is 6 mm, and the ball-to-material ratio (mass ratio) is 6:1. High-purity argon with a purity of 99.99% is used for ball milling as a protective gas. Before the hydrothermal reaction, the filling degree of the precursor solution in the reactor is 90%.

Embodiments of Preparation Method for Tungsten-Base Alloy Material

Embodiment 1

The preparation method for the tungsten-base alloy material of this embodiment includes the following steps.

1) Preparation of Mixed Powder Consisting of Zirconium Oxide and Tungsten 125.395 kg of ammonium metatungstate ($(NH_4)_6H_2W_{12}O_{40}\cdot xH_2O$, equivalent to metal W: 93.00 kg) was dissolved in water, and nitric acid was added dropwise to pH 1 to obtain the precursor solution A. Then the precursor solution A was subjected to a hydrothermal reaction at 150° C. The time of the hydrothermal reaction is 15 hours, and the tungsten trioxide suspension is obtained after the hydrothermal reaction is over.

0.232 kg of zirconium nitrate (equivalent to $ZrO_2$:0.066 kg) was dissolved in water, and then ammonia water was added dropwise to pH 12 to obtain the precursor solution B. Then the precursor solution B was subjected to a hydrothermal reaction at 150° C. The time of the hydrothermal reaction is 15 hours, and the hydrogen zirconium oxide suspension is obtained after the hydrothermal reaction is over.

The prepared tungsten trioxide suspension and hydrogen zirconium oxide suspension were uniformly mixed and filtered, and then dried to obtain a dry powder. The dry powder was sintered at 600° C. for 4 hours, and then the sintered product was placed into a rod reduction furnace to carry out the two-stage hydrogen reduction, passing through a 120-mesh screen to obtain a mixed powder. The temperature of the first-stage hydrogen reduction is 750° C., and the reduction time is 1 hour. The temperature of the second-stage hydrogen reduction is 930° C., and the reduction time is 3 hours.

2) Preparation of Zirconium Hydride-Containing Nickel-Iron Solid Solution:

4.83 kg of nickel powder and 2.07 kg of iron powder were weighed according to a mass ratio of 7:3. Meanwhile, 0.033 kg of zirconium hydride was weighed and placed into a high-energy stirring ball mill. The rotation speed of the ball mill was set to 300 rpm, and the ball milling time was 12 hours to prepare the zirconium hydride-containing nickel-iron solid solution with sub-micron size.

3) Mixing 93.066 kg of mixed powder and 6.933 kg of zirconium hydride-containing nickel-iron solid solution powder were placed in a high-energy stirring ball mill for the first ball milling. The rotation speed was set to 300 rpm, and the ball milling was carried out for 12 hours. Then the powder obtained from the first ball milling was placed in a hydrogen furnace in a hydrogen atmosphere and kept at 800° C. for 2 hours, and then cooled in the furnace. Thereafter, the powder was ball milled for the second time, the rotation speed was set to 300 rpm, and ball milled for 8 hours.

4) Compression and Sintering Moulding

The powder obtained from the second ball milling was placed into a rubber sleeve with a wall thickness of about 2 mm, and then placed in a 350 MPa ultra-high pressure chamber for cold isostatic pressing, and the pressure holding time was 30 minutes to obtain a cold pressed blank.

Subsequently, the prepared cold pressed blank was placed in a hydrogen protective sintering furnace, and liquid-phase sintering was performed at 1500° C. for a sintering time of 120 minutes to obtain a sintered blank. Then the sintered blank was placed in an argon atmosphere at 1200° C. and kept for 5 hours for dehydrogenation treatment.

5) Hydrostatic Extrusion Deformation Treatment and Aging Treatment

The dehydrogenated sintered blank was subjected to turning processing and other processes to form a hydrostatic extrusion blank sample, which was then placed in a hydrostatic extruder for cold extrusion deformation. The working pressure of the hydrostatic extrusion treatment was 1000 MPa, the extrusion speed was 35 m/s, and the alloy after the extrusion deformation was subjected to aging treatment. The temperature of the aging treatment was 900° C., and the time of the aging treatment was 9 hours, and finally the tungsten-base alloy material in extrusion state was obtained.

Embodiment 2

The preparation method for the tungsten-base alloy material of this embodiment includes the following steps.

1) Preparation of Mixed Powder Consisting of Zirconium Oxide and Tungsten

The tungsten trioxide suspension was prepared according to the preparation method for the tungsten trioxide suspension in Embodiment 1.

0.464 kg of zirconium nitrate (equivalent to $ZrO_2$:0.133 kg) was dissolved in water, and then ammonia was added dropwise to pH 12 to obtain the precursor solution B, and then the precursor solution B was subjected to a hydrothermal reaction at 150° C. The time of hydrothermal reaction was 15 hours. A hydrogen zirconium oxide suspension was obtained after the hydrothermal reaction was over.

The prepared tungsten trioxide suspension and hydrogen zirconium oxide suspension were uniformly mixed and filtered, and then dried to obtain a dry powder. The dry powder was sintered at 600° C. for 2 hours, and then the sintered product was put into a rod reduction furnace to carry out the two-stage hydrogen reduction, passing through a 120-mesh screen to obtain a mixed powder. The temperature of the first-stage hydrogen reduction was 730° C., the reduction time was 2 hours; the temperature of the second-stage hydrogen reduction was 940° C., and the reduction time was 3 hours.

2) Preparation of Zirconium Hydride-Containing Nickel-Iron Solid Solution:

4.76 kg of nickel powder and 2.04 kg of iron powder were weighed according to a mass ratio of 7:3. Meanwhile, 0.067 kg of zirconium hydride was weighed and placed into a high-energy stirring ball mill. The rotation speed of the ball mill was set to 300 rpm, and the ball milling time was 12 hours to prepare the zirconium hydride-containing nickel-iron solid solution with sub-micron size.

3) Mixing 93.133 kg of mixed powder and 6.867 kg of zirconium hydride-containing nickel-iron solid solution powder were placed in a high-energy stirring ball mill for the first ball milling. The rotation speed was set to 250 rpm, and the ball milling was carried out for 14 hours. Then the powder obtained from the first ball milling was placed in a hydrogen furnace in a hydrogen atmosphere and kept at 800° C. for 2 hours, and then cooled in the furnace. Thereafter, the powder was ball milled for the second time, the rotation speed was set to 300 rpm, and ball milled for 8 hours.

4) Compression and Sintering Moulding

The powder obtained from the second ball milling was placed into a rubber sleeve with a wall thickness of about 2 mm, and then placed in a 300 MPa ultra-high pressure chamber for cold isostatic pressing, and the pressure holding time was 35 minutes to obtain a cold pressed blank.

Subsequently, the prepared cold pressed blank was placed in a hydrogen protective sintering furnace, and liquid-phase sintering was performed at 1480° C. for a sintering time of 135 minutes to obtain a sintered blank. Then the sintered blank was placed in an argon atmosphere at 1200° C. and kept for 5 hours for dehydrogenation treatment.

5) Hydrostatic Extrusion Deformation Treatment and Aging Treatment

The dehydrogenated sintered blank was subjected to turning processing and other processes to form a hydrostatic extrusion blank sample, which was then placed in a hydrostatic extruder for cold extrusion deformation. The working pressure of the hydrostatic extrusion treatment was 1200 MPa, the extrusion speed was 40 m/s, and the alloy after the extrusion deformation was subjected to aging treatment. The temperature of the aging treatment was 1100° C., and the time of the aging treatment was 7 hours, and finally the tungsten-base alloy material in extrusion state was obtained.

Embodiment 3

The preparation method for the tungsten-base alloy material of this embodiment includes the following steps.

1) Preparation of Mixed Powder Consisting of Zirconium Oxide and Tungsten

The tungsten trioxide suspension was prepared according to the preparation method for the tungsten trioxide suspension in Embodiment 1.

0.697 kg of zirconium nitrate (equivalent to $ZrO_2$:0.200 kg) was dissolved in water, and then ammonia was added dropwise to pH 12 to obtain the precursor solution B, and then the precursor solution B was subjected to a hydrothermal reaction at 150° C. The time of hydrothermal reaction was 15 hours. A hydrogen zirconium oxide suspension was obtained after the hydrothermal reaction was over.

The prepared tungsten trioxide suspension and hydrogen zirconium oxide suspension were uniformly mixed and filtered, and then dried to obtain a dry powder. The dry powder was sintered at 600° C. for 2 hours, and then the sintered product was put into a rod reduction furnace to carry out the two-stage hydrogen reduction, passing through a 120-mesh screen to obtain a mixed powder. The temperature of the first-stage hydrogen reduction was 740° C., the reduction time was 1 hour; the temperature of the second-stage hydrogen reduction was 935° C., and the reduction time was 3 hours.

2) Preparation of Zirconium Hydride-Containing Nickel-Iron Solid Solution:

4.69 kg of nickel powder and 2.01 kg of iron powder were weighed according to a mass ratio of 7:3. Meanwhile, 0.100 kg of zirconium hydride was weighed and placed into a high-energy stirring ball mill. The rotation speed of the ball mill was set to 300 rpm, and the ball milling time was 12 hours to prepare the zirconium hydride-containing nickel-iron solid solution with sub-micron size.

3) Mixing 93.200 kg of mixed powder and 6.800 kg of zirconium hydride-containing nickel-iron solid solution powder were placed in a high-energy stirring ball mill for the first ball milling. The rotation speed was set to 280 rpm, and the ball milling was carried out for 16 hours. Then the powder obtained from the first ball milling was placed in a hydrogen furnace in a hydrogen atmosphere and kept at 800° C. for 2 hours, and then cooled in the furnace. Thereafter, the powder was ball milled for the second time, the rotation speed was set to 300 rpm, and ball milled for 8 hours.

4) Compression and Sintering Moulding

The powder obtained from the second ball milling was placed into a rubber sleeve with a wall thickness of about 2 mm, and then placed in a 350 MPa ultra-high pressure chamber for cold isostatic pressing, and the pressure holding time was 30 minutes to obtain a cold pressed blank.

Subsequently, the prepared cold pressed blank was placed in a hydrogen protective sintering furnace, and liquid-phase sintering was performed at 1530° C. for a sintering time of 95 minutes to obtain a sintered blank. Then the sintered blank was placed in an argon atmosphere at 1200° C. and kept for 5 hours for dehydrogenation treatment.

5) Hydrostatic Extrusion Deformation Treatment and Aging Treatment

The dehydrogenated sintered blank was subjected to turning processing and other processes to form a hydrostatic extrusion blank sample, which was then placed in a hydrostatic extruder for cold extrusion deformation. The working pressure of the hydrostatic extrusion treatment was 950 MPa, the extrusion speed was 40 m/s, and the alloy after the extrusion deformation was subjected to aging treatment. The temperature of the aging treatment was 800° C., and the time of the aging treatment was 10 hours, and finally the tungsten-base alloy material in extrusion state was obtained.

Embodiment 4

The preparation method for the tungsten-base alloy material of this embodiment includes the following steps.

1) Preparation of Mixed Powder Consisting of Zirconium Oxide and Tungsten

The tungsten trioxide suspension was prepared according to the preparation method for the tungsten trioxide suspension in Embodiment 1.

0.929 kg of zirconium nitrate (equivalent to $ZrO_2$:0.267 kg) was dissolved in water, and then ammonia was added dropwise to pH 12 to obtain the precursor solution B, and then the precursor solution B was subjected to a hydrothermal reaction at 150° C. The time of hydrothermal reaction was 15 hours. A hydrogen zirconium oxide suspension was obtained after the hydrothermal reaction was over.

The prepared tungsten trioxide suspension and hydrogen zirconium oxide suspension were uniformly mixed and filtered, and then dried to obtain a dry powder. The dry powder was sintered at 600° C. for 2 hours, and then the sintered product was put into a rod reduction furnace to carry out the two-stage hydrogen reduction, passing through a 120-mesh screen to obtain a mixed powder. The temperature of the first-stage hydrogen reduction was 770° C., the reduction time was 2 hours; the temperature of the second-stage hydrogen reduction was 900° C., and the reduction time was 3 hours.

2) Preparation of Zirconium Hydride-Containing Nickel-Iron Solid Solution:

4.62 kg of nickel powder and 1.98 kg of iron powder were weighed according to a mass ratio of 7:3. Meanwhile, 0.133 kg of zirconium hydride was weighed and placed into a high-energy stirring ball mill. The rotation speed of the ball mill was set to 300 rpm, and the ball milling time was 12 hours to prepare the zirconium hydride-containing nickel-iron solid solution with sub-micron size.

3) Mixing 93.267 kg of mixed powder and 6.733 kg of zirconium hydride-containing nickel-iron solid solution powder were placed in a high-energy stirring ball mill for the first ball milling. The rotation speed was set to 350 rpm, and the ball milling was carried out for 13 hours. Then the powder obtained from the first ball milling was placed in a hydrogen furnace in a hydrogen atmosphere and kept at 800° C. for 2 hours, and then cooled in the furnace. Thereafter, the powder was ball milled for the second time, the rotation speed was set to 300 rpm, and ball milled for 8 hours.

4) Compression and Sintering Moulding

The powder obtained from the second ball milling was placed into a rubber sleeve with a wall thickness of about 2 mm, and then placed in a 400 MPa ultra-high pressure chamber for cold isostatic pressing, and the pressure holding time was 40 minutes to obtain a cold pressed blank.

Subsequently, the prepared cold pressed blank was placed in a hydrogen protective sintering furnace, and liquid-phase sintering was performed at 1490° C. for a sintering time of 130 minutes to obtain a sintered blank. Then the sintered blank was placed in an argon atmosphere at 1200° C. and kept for 5 hours for dehydrogenation treatment.

5) Hydrostatic Extrusion Deformation Treatment and Aging Treatment

The dehydrogenated sintered blank was subjected to turning processing and other processes to form a hydrostatic extrusion blank sample, which was then placed in a hydrostatic extruder for cold extrusion deformation. The working pressure of the hydrostatic extrusion treatment was 1300 MPa, the extrusion speed was 50 m/s, and the alloy after the extrusion deformation was subjected to aging treatment. The temperature of the aging treatment was 1000° C., and the time of the aging treatment was 8 hours, and finally the tungsten-base alloy material in extrusion state was obtained.

The scanning electron micrograph of the tungsten-base alloy material prepared by the preparation method of this embodiment is shown in FIGURE, and it can be seen from FIGURE that the average crystal grain size of the tungsten-base alloy material is 30 μm.

Embodiment 5

The differences between the preparation method for tungsten-base alloy material in this embodiment and the preparation method for tungsten-base alloy material in Embodiment 1 are as follows.

In step 2), the rotation speed of the ball mill was 200 rpm and the time was 16 hours.

The ball-to-material ratio (mass ratio) adopted in the ball milling process in step 2) and step 3) is both 5:1.

In step 3), the 93.066 kg of mixed powder prepared in step 1), 6.9 kg of nickel-iron solid solution prepared in step 2) and 0.033 kg of zirconium hydride were mixed and then ball milled for the first time.

In step 3), the rotation speed of the second ball milling was 200 rpm, and the time was 10 hours.

In step 3), the temperature kept in hydrogen was 1000° C., and the temperature-holding time was 1 hour.

Step 4), the temperature of the dehydrogenation treatment was 1150° C., and the time was 6 hours.

Embodiment 6

The preparation method for the tungsten-base alloy material of this embodiment differs from that of Embodiment 5 only in that: in step 2), the ball-to-material ratio of the ball mill (mass ratio 8:1), the rotation speed of the ball mill was 350 rpm, and the time was 12 hours.

Embodiment 7

The preparation method for the tungsten-base alloy material of this embodiment differs from the preparation method for the tungsten-base alloy material in Embodiment 1 in that step 2) is omitted.

In step 3), the 93.066 kg of mixed powder prepared in step 1), 4.1 kg of nickel powder, 2.8 kg of iron powder, and 0.033 kg of zirconium hydride were mixed and then ball milled for the first time.

The ball-to-material ratio (mass ratio) used in the ball milling process in step 3) was 8:1, the rotation speed of the second ball milling was 400 rpm, and the time of the second ball milling was 6 hours.

In step 3), the temperature kept in a hydrogen atmosphere was 700° C., and the temperature-holding time was 3 hours.

In step 4), the temperature of the dehydrogenation treatment was 1300° C., and the time was 4 hours.

Embodiment 8

The preparation method for the tungsten-base alloy material of this embodiment differs from the preparation method for the tungsten-base alloy material in Embodiment 7 only in that the mass of the nickel powder adopted is 5.36 kg, and the mass of the iron powder is 1.54. kg.

Embodiment of Tungsten-Base Alloy Material

Embodiment 9

The tungsten-base alloy material of this embodiment is prepared by any one of the preparation methods of the tungsten-base alloy material in the above-mentioned Embodiments 1 to 8, and no further description is incorporated herein.

Comparative Example

The preparation method for the tungsten-base alloy material of this comparative example is different from the preparation method for the tungsten-base alloy material of Embodiment 2 only in that: this comparative example omits the step of performing temperature-holding in hydrogen furnace and the step of performing the second time of ball milling after the temperature-holding process in the hydrogen furnace in step 3) of Embodiment 2.

Experimental Example

The tungsten-base alloy material prepared by the preparation method for tungsten-base alloy material of Embodiments 1 to 4 and the comparative example were taken to carry out experiments. The grain size of the alloy was measured by the cut-line method, and the alloy density was measured by the Archimedes drainage method. The microhardness tester (model: HMAS-C1000SZA) was adopted to measure the microhardness of the alloy, and the precision universal material testing machine (model: AG-I250KN) was adopted to measure the tensile strength of the alloy. The results are shown in Table 1 below.

TABLE 1

Performance test results of tungsten-base alloy material prepared in Embodiments 1 to 4 and Comparative Example

| Performance parameter | Grain size (μm) | Density (g/cm3) | Micro-hardness (Hv) | Tensile strength (MPa) | Elongation rate (%) |
|---|---|---|---|---|---|
| Embodiment 1 | 30 | 17.9 | 450 | 1450 | 16.1 |
| Embodiment 2 | 27 | 17.8 | 445 | 1490 | 15.8 |
| Embodiment 3 | 23 | 17.7 | 460 | 1530 | 15.3 |
| Embodiment 4 | 20 | 17.5 | 455 | 1480 | 15.2 |
| Comparative Example | 13 | 17.5 | 402 | 1256 | 17 |

It can be seen from Table 1 that the tensile strength of the tungsten-base alloy material in Embodiments 1 to 4 is 1450

MPa or more, which is about 15% higher than that of conventional tungsten alloy; the elongation rate is 15% or more, which satisfies the high strength and high plasticity requirements for elastic materials. The grain size, density, microhardness and tensile strength of the tungsten-base alloy material prepared in Embodiments 5 to 8 are basically at the same level as the tungsten-base alloy material prepared in Embodiments 1 to 4.

What is claimed is:

1. A preparation method for a tungsten-base alloy material, comprising the following steps:

1) A composite powder is evenly ground then subjected to an annealing treatment at a temperature of 700 to 1000° C. to obtain a powder A; the composite powder is a powder I, a powder II or a powder III; the powder I contains tungsten, zirconium oxide, nickel and iron; the powder II contains tungsten, zirconium oxide, and a nickel-iron solid solution; the powder III contains tungsten, zirconium oxide, and a zirconium hydride-containing nickel-iron solid solution; a mass ratio of a nickel element and an iron element in the composite powder is 7:2 to 5;

2) The powder A is ground and compression-moulded into a shape, and then liquid-phase sintered to obtain a tungsten-base alloy blank, wherein the powder I is obtained by mixing an iron powder, a nickel powder and a mixed powder as main raw materials; the powder II is obtained by mixing a nickel-iron solid solution powder and a mixed powder as main raw materials; and the powder III is obtained by mixing the zirconium hydride-containing nickel-iron solid solution and a mixed powder; the mixed powder used to prepare the powder I, the powder II, and the powder III is prepared by a method comprising the following steps:

i) a tungsten trioxide suspension and a hydrogen zirconium oxide suspension are prepared:

a) ammonium metatungstate is formulated into a precursor solution A with a pH≤1, and then the precursor solution A is subjected to a hydrothermal reaction to obtain the tungsten trioxide suspension;

b) zirconium nitrate is formulated into a precursor solution B with a pH of 11 to 13, and then the precursor solution B is subjected to a hydrothermal reaction to obtain the hydrogen zirconium oxide suspension;

ii) then the tungsten trioxide suspension and the hydrogen zirconium oxide suspension are mixed uniformly, a solvent is removed to make a powder, and then the powder is sequentially sintered and reduced to obtain the mixed powder.

2. The preparation method for the tungsten-base alloy material according to claim 1, wherein a ratio of the mass of tungsten, the mass of zirconium oxide, and the total mass of nickel and iron in the powder I is 93:0.066 to 0.267:6.5 to 6.9; a mass ratio of tungsten, zirconium oxide and the nickel-iron solid solution in the powder II is 93:0.066 to 0.267:6.5 to 6.9; a mass ratio of tungsten, zirconium oxide, and the zirconium hydride-containing nickel-iron solid solution in the powder III is 93:0.066 to 0.267:6.533 to 7.033, and a mass ratio of zirconium hydride to zirconium hydride contained in the zirconium hydride-containing nickel-iron solid solution is 0.066 to 0.267:0.033 to 0.133.

3. The preparation method for the tungsten-base alloy material according to claim 1, wherein the powder I consists of tungsten, zirconium oxide, nickel, iron, and zirconium hydride, a ratio of the mass of tungsten, the mass of zirconium oxide, the total mass of nickel and iron and the mass of zirconium hydride in the powder I is 93:0.066 to 0.267:6.5 to 6.9:0.033 to 0.133; the powder II consists of tungsten, zirconium oxide, the nickel-iron solid solution and zirconium hydride, a mass ratio of tungsten, zirconium oxide, the nickel-iron solid solution and zirconium hydride in the powder II is 93:0.066 to 0.267:6.5 to 6.9:0.033 to 0.133.

4. The preparation method for the tungsten-base alloy material according to claim 1, wherein in step 2), the grinding is ball milling; a rotating speed of the ball milling is 200 to 400 rpm, a time for grinding is 6 to 10 hours, and a ball-to-material ratio is 5 to 8:1.

5. The preparation method for the tungsten-base alloy material according to claim 1, wherein the annealing treatment is performed at 700 to 1000° C., and the temperature is kept for 1 to 3 hours.

6. The preparation method for the tungsten-base alloy material according to claim 1, wherein a preparation method for the zirconium hydride-containing nickel-iron solid solution in the powder III comprises the following steps: a nickel powder, an iron powder and a zirconium hydride powder are mixed and then ball milled to obtain the powder III; in the preparation method for the zirconium hydride-containing nickel-iron solid solution, a rotation speed of the ball milling is 200 to 350 rpm, a time for ball milling is 12 to 16 hours, and a ball-to-material ratio is 5 to 8:1.

7. The preparation method for the tungsten-base alloy material according to claim 1, wherein in step a), a temperature of the hydrothermal reaction is 120 to 180° C., and a time for the hydrothermal reaction is 12 to 18 hours.

8. The preparation method for the tungsten-base alloy material according to claim 1, wherein in step b), a temperature of the hydrothermal reaction is 120 to 180° C., and a time for the hydrothermal reaction is 12 to 18 hours.

9. The preparation method for the tungsten-base alloy material according to claim 1, wherein in step ii), a temperature of the sintering is 600 to 700° C.; a time of the sintering is 3 to 5 hours.

10. The preparation method for the tungsten-base alloy material according to claim 1, wherein in step ii), the reduction is a two-stage reduction; a temperature of a first-stage reduction is 700 to 770° C., and a time for the first-stage reduction is 1 to 2 hours; a temperature of a second-stage reduction is 900 to 950° C., and a time for the second-stage reduction is 2 to 4 hours.

11. The preparation method for the tungsten-base alloy material according to claim 1, further comprising: the tungsten-base alloy blank is subjected to a hydrostatic extrusion deformation treatment and an aging treatment; a temperature of the aging treatment is 800 to 1100° C., and a time of the aging treatment is 7 to 10 hours.

12. The preparation method for the tungsten-base alloy material according to claim 11, wherein before the hydrostatic extrusion deformation treatment is performed, the prepared tungsten-base alloy blank is subjected to a dehydrogenation treatment; the dehydrogenation treatment is carried out in an inert atmosphere at a temperature of 1150 to 1300° C., and the temperature is kept for 4 to 6 hours, and then the tungsten-base alloy blank is cooled in a furnace.

13. The preparation method for the tungsten-base alloy material according to claim 11, wherein a working pressure of the hydrostatic extrusion deformation treatment is 950 to 1300 MPa, and an extrusion speed is 30 to 50 m/s.

14. The preparation method for the tungsten-base alloy material according to claim 11, wherein a deformation rate of the hydrostatic extrusion deformation treatment is 15 to 50%.

15. The preparation method for the tungsten-base alloy material according to claim 1, wherein a pressure used for the compression moulding is 300 to 400 MPa, and a pressure holding time is 30 to 40 minutes.

16. The preparation method for the tungsten-base alloy material according to claim 1, wherein a temperature of the liquid phase sintering is 1450 to 1550° C.; a time of the liquid phase sintering is 90 to 150 minutes.

17. The preparation method for the tungsten-base alloy material according to claim 16, wherein the temperature of the liquid phase sintering is 1480 to 1540° C.; the time of the liquid phase sintering is 90 to 135 minutes.

* * * * *